US009926664B2

(12) United States Patent
Kono et al.

(10) Patent No.: US 9,926,664 B2
(45) Date of Patent: Mar. 27, 2018

(54) TUFTED CARPET CONTINUOUS DYEING METHOD AND TUFTED CARPET CONTINUOUS DYEING MACHINE

(71) Applicant: TOABO MATERIAL CO., LTD., Osaka (JP)

(72) Inventors: Masakichi Kono, Yokkaichi (JP); Toru Kubo, Yokkaichi (JP); Itsuo Kawakita, Yokkaichi (JP)

(73) Assignee: TOABO MATERIAL CO., LTD. (JP)

( * ) Notice: Subject to any disclaimer, the term of this patent is extended or adjusted under 35 U.S.C. 154(b) by 0 days.

(21) Appl. No.: 15/271,113

(22) Filed: Sep. 20, 2016

(65) Prior Publication Data

US 2017/0152628 A1 Jun. 1, 2017

(30) Foreign Application Priority Data

Nov. 27, 2015 (JP) ..... 2015-231341

(51) Int. Cl.

| | |
|---|---|
| ***D06B 11/00*** | (2006.01) |
| ***D06P 1/00*** | (2006.01) |
| ***D06P 1/39*** | (2006.01) |
| ***D06P 5/20*** | (2006.01) |

(52) U.S. Cl.

CPC ..... *D06P 1/0096* (2013.01); *D06B 11/00* (2013.01); *D06P 1/39* (2013.01); *D06P 5/2077* (2013.01)

(58) Field of Classification Search

CPC ..... D06P 1/0096; D06P 1/39; D06P 5/2077; D06P 11/00; D06P 11/002; D06P 11/0023; D06P 11/003

See application file for complete search history.

(56) References Cited

U.S. PATENT DOCUMENTS 4,377,080 A * 3/1983 Fox ..... D06B 1/08 137/561 A 4,547,921 A 10/1985 Otting et al.

FOREIGN PATENT DOCUMENTS

| | | | |
|---|---|---|---|
| JP | 5512897 | A | 1/1980 |
| JP | 616385 | A | 1/1986 |
| JP | 61245361 | A | 10/1986 |
| JP | 06025981 | A | 2/1994 |
| JP | 07133595 | A | 5/1995 |
| JP | 08127983 | A | 5/1996 |
| JP | 11081162 | A | 3/1999 |
| JP | 2004027437 | A | 1/2004 |
| JP | 2004107852 | A | 4/2004 |

* cited by examiner

*Primary Examiner* — Amina Khan

(74) *Attorney, Agent, or Firm* — Kolisch Hartwell, P.C.

(57) ABSTRACT

A continuous dyeing method for long original tufted carpets, including applying a dyeing liquid to the carpet while running it in the longitudinal direction with a continuous dyeing machine that includes a dyeing liquid supply applicator having an independent supply route A and supply route B, each having a plurality of nozzles capable of applying dyeing liquid to the original tufted carpet so as to uniformly flow onto the original tufted carpet through a plate. The nozzles of supply route A and supply route B are alternately aligned in the width direction, with at least one of the nozzles of each of supply routes A and B opened by the control of an opening means. The present continuous dyeing method is capable of easily dyeing an original tufted carpet a mixture of colors and/or various patterns by gradation.

5 Claims, 6 Drawing Sheets

[Fig. 1]
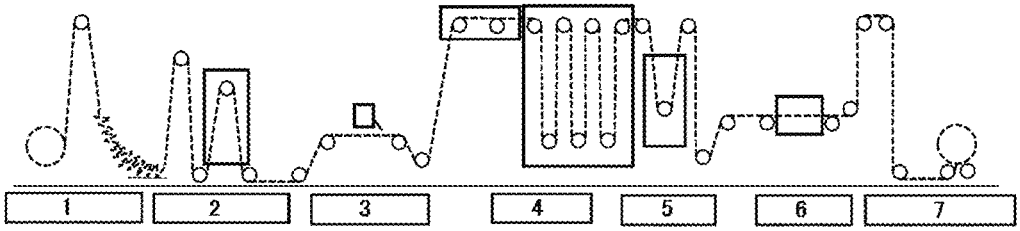
[Fig. 2]
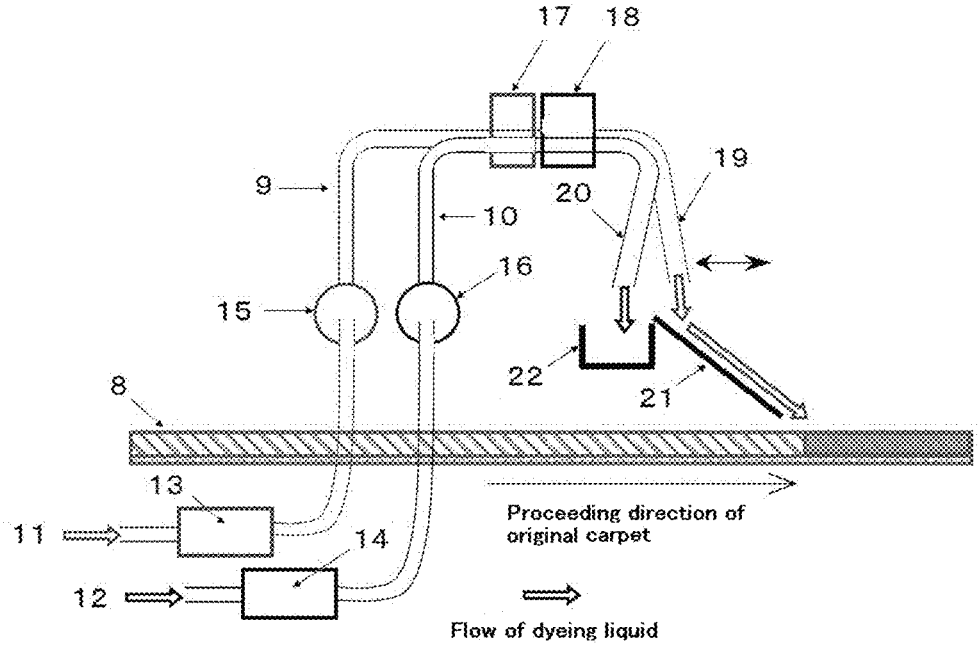

[Fig. 3]
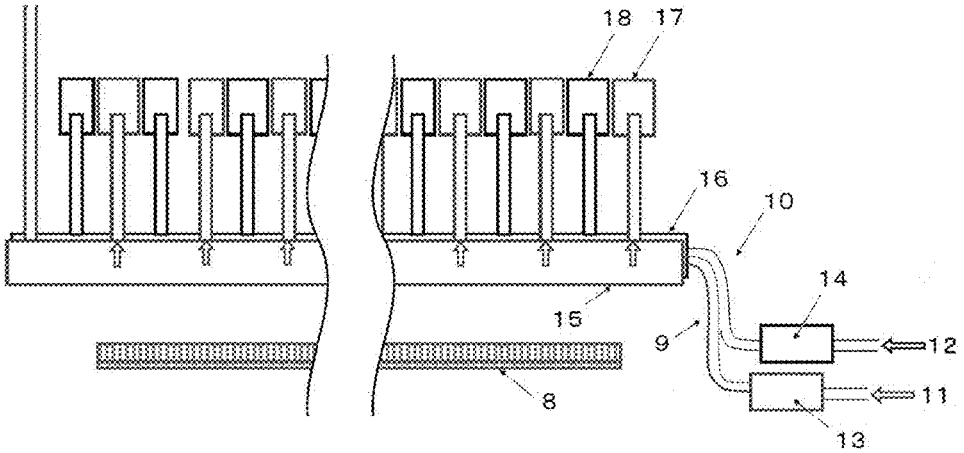
[Fig. 4]
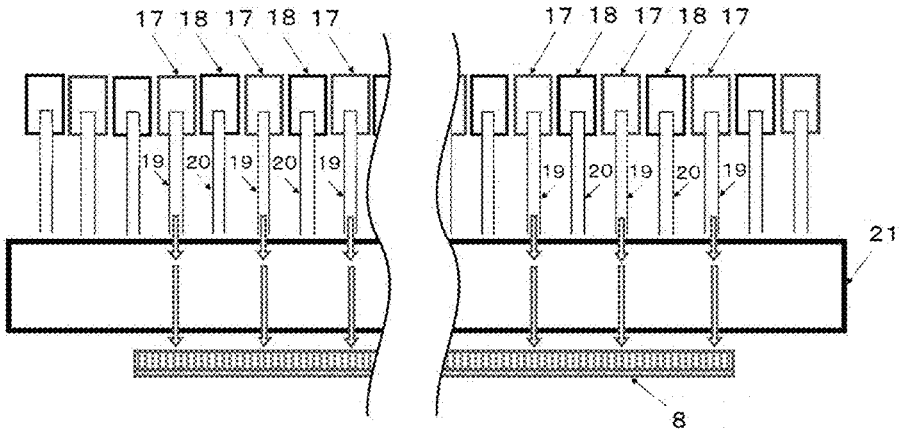
[Fig. 5]
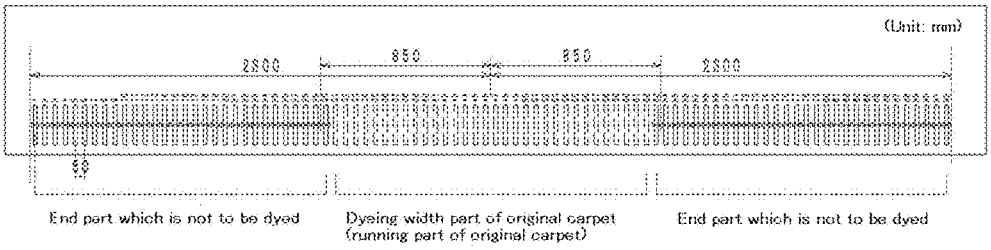

[Fig. 6]
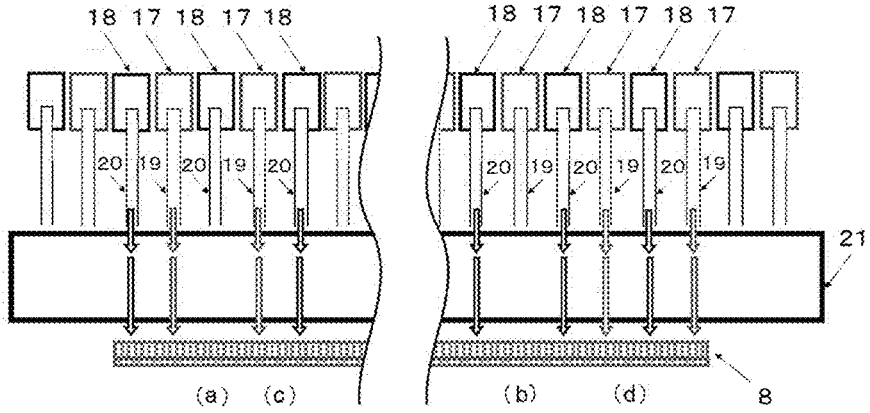

[Fig. 7]
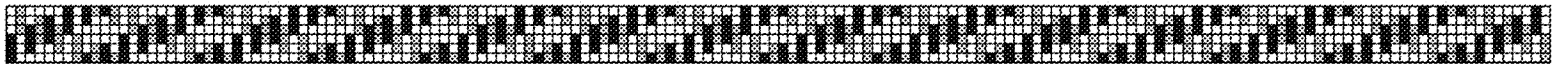

[Fig. 8]
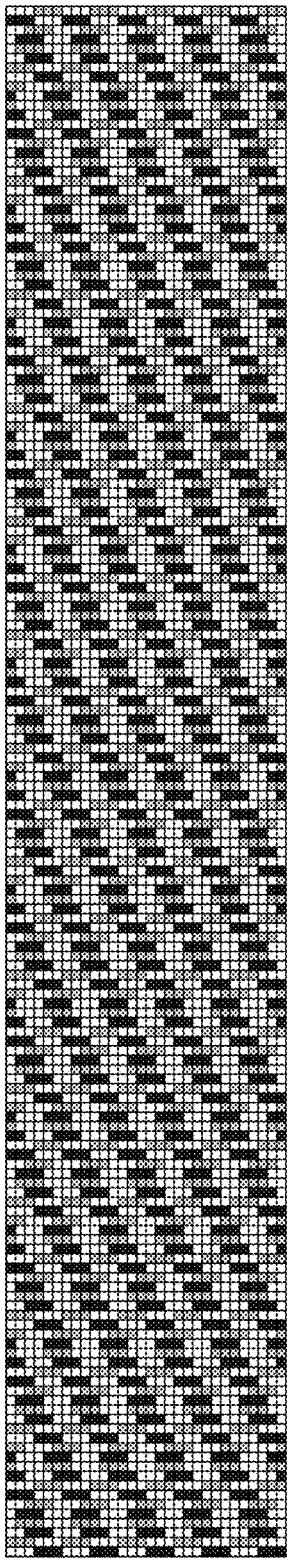

[Fig. 9]
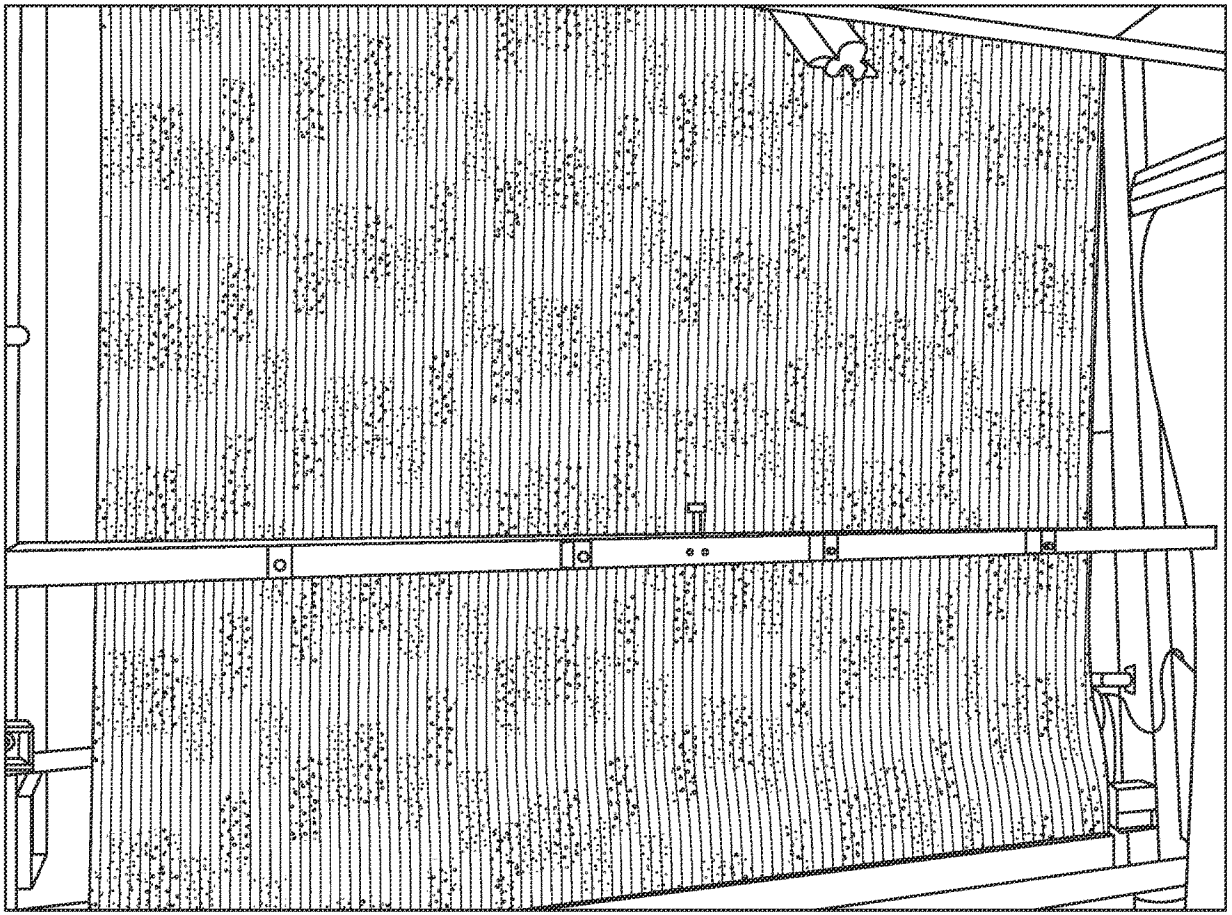

TUFTED CARPET CONTINUOUS DYEING METHOD AND TUFTED CARPET CONTINUOUS DYEING MACHINE

TECHNICAL FIELD OF THE INVENTION

The present invention relates to a continuous dyeing method and a continuous dyeing machine which are capable of easily dyeing a long original tufted carpet in various hues such as a hue having a gradational change and a hue of mixture of any two colors.

BACKGROUND ART

Carpets are widely used in office buildings, housing, and the like, as a floor material which has a high thermal insulation effect and a high sound insulation effect, provides easy conveyance and installation, and is partially replaceable. Carpets are made of various fiber materials, and have a variety of colors and textures, so that they are an important interior item to enrich the living.

The types of carpets are classified into, for example, a tufted carpet, a Wilton carpet, a bonded carpet, a knitted carpet, and a needle punched carpet according to the difference of the manufacturing methods thereof. Among the types of carpets, the tufted carpet is obtained by penetrating, with sewing machine needles, a pile yarn of nylon, wool, polyester, polypropylene, acryl, or the like into a backing fabric (woven backing fabric, spunbonded fabric) to continuously make loop or cut piles. The specification of the tufted carpet is determined by the number of penetrations (gauge) in the width direction of the carpet, the number of penetrations in the length direction (stitch), and the length of a pile (pile height).

The tufted carpet is produced by a tufting machine. In the tufting machine, needles are arranged with the same intervals in the width direction and a pile yarn is penetrated into a backing fabric with these needles. The interval among the needles is called a gauge. For example, a 1/10 gauge (G) tufting machine has 10 needles in 1 inch in the width direction, i.e. about 1600 needles in a width of 4 m. A yarn is put through a needle and the yarn is penetrated into a backing fabric fed at a constant speed to form a pile for making an uncolored original tufted carpet. The made original carpet is subjected to a dyeing process.

A common method for dyeing a tufted carpet includes a continuous dyeing method of continuously dyeing a long original tufted carpet while running it in the longitudinal direction (for example, see Patent Document 1), a wince dyeing method of connecting a certain length of a tufted original carpet in a rope shape within a dyeing machine, and dyeing the original carpet while turning it around, and a print dyeing method of dyeing an original carpet with a pattern dyeing machine of screen printing, jet printing, or the like. The print dyeing method is excellent in attainability of expression of a fine pattern, but has slow processing speed and has high production costs. Therefore, the print dyeing method is rarely used except for producing a luxury product. The wince dyeing method has lower production costs than the print dyeing method, but cannot attain expression of a fine pattern and is not suitable for mass production. On the other hand, the continuous dyeing method has high processing speed and has low production costs, and therefore, is widely and commonly used. However, the continuous dyeing method is, basically, a method aiming at dyeing for even and single color expression so that color difference does not appear in the width direction and the length direction.

Therefore, in the present circumstances, it is not considered to attain expression of a pattern by gradation, or mixture of a plurality of colors by the continuous dyeing method.

PRIOR ART DOCUMENTS

Patent Documents

Patent Document 1: Japanese Patent Application Laid-Open (JP-A) No. 25981/94

DISCLOSURE OF THE INVENTION

Problem that the Invention is to Solve

The present invention is invented in view of the present circumstances of the continuous dyeing method of the conventional technique described above. An object of the present invention is to improve the conventional continuous dyeing method to provide a continuous dyeing method and a continuous dyeing machine which are capable of easily dyeing an original tufted carpet in expression of various patterns by gradation, mixture of a plurality of colors, or the like.

Means for Solving the Problem

The present inventors have conducted earnest studies to achieve the above object and found that dyeing for expression of various patterns excellent in appearance can be continuously imparted to an original tufted carpet easily, only by slight improvement of the conventional continuous dyeing machine. The improvement includes alternately aligning, in the width direction, nozzles of two dyeing liquid supply routes conventionally made for alternate use of the nozzles for shortening the time for switching to a dyeing liquid to be used next, so that the nozzles can be simultaneously used in a dyeing liquid supply applicator part of the continuous dyeing machine; differentiating in the hue or density between dyeing liquids supplied to these dyeing liquid supply routes at this time; and controlling by an opening means the discharge of the dyeing liquids from the nozzles of these dyeing liquid supply routes. Thus, the present invention has been completed.

That is, the present invention includes the following configurations (1) to (6).

(1) A tufted carpet continuous dyeing method for dyeing a long original tufted carpet by applying a dyeing liquid to the original tufted carpet while running the original tufted carpet in the longitudinal direction with a continuous dyeing machine, wherein the continuous dyeing machine includes a dyeing liquid supply applicator having a dyeing liquid supply route A and a dyeing liquid supply route B which are independent from each other, wherein each of the dyeing liquid supply route A and the dyeing liquid supply route B has a plurality of nozzles capable of executing and stopping the discharge of the dyeing liquid by opening and closing of an opening means, wherein the dyeing liquid discharged from the nozzles is applied to the original tufted carpet in such a manner as to uniformly flow onto the original tufted carpet through a plate; wherein the nozzles of the dyeing liquid supply route A and the nozzles of the dyeing liquid supply route B are aligned together in the width direction in alternate order, and at least one of the nozzles of the dyeing liquid supply route A and at least one of the nozzles of the dyeing liquid supply route B are opened by the control of opening and closing of the opening means; and wherein dyeing liquids different from each other in the hue or density are simultaneously supplied to the dyeing liquid supply route A and the dyeing liquid supply route B, respectively, the dyeing liquids are discharged from the opened nozzles, the dyeing liquids different from each other in the hue or density fall on the plate, and then they contact with each other from the width direction on the plate so that they are partially mixed with each other, and then these dyeing liquids are applied to the original tufted carpet for dyeing.

(2) The method according to (1), wherein the periods of the opening and closing of the nozzles by the opening means are set to specific periods, respectively.

(3) The method according to (1) or (2), wherein the opening means is controlled so that the dyeing liquid is discharged from the nozzles only in a width size of the tufted carpet to which the dyeing liquid is to be applied.

(4) A tufted carpet continuous dyeing machine for dyeing a long original tufted carpet by applying a dyeing liquid to the original tufted carpet while running the original tufted carpet in the longitudinal direction, wherein the continuous dyeing machine includes a dyeing liquid supply applicator having a dyeing liquid supply route A and a dyeing liquid supply route B which are independent from each other, wherein each of the dyeing liquid supply route A and the dyeing liquid supply route B has a plurality of nozzles capable of executing and stopping the discharge of the dyeing liquid by opening and closing of an opening means, wherein the continuous dyeing machine is configured to apply the dyeing liquid discharged from the nozzles to the original tufted carpet so that the dyeing liquid uniformly flows onto the original tufted carpet through a plate; wherein the nozzles of the dyeing liquid supply route A and the nozzles of the dyeing liquid supply route B are capable of being aligned together in the width direction in alternate order, and the continuous dyeing machine is configured to be capable of opening at least any one of the nozzles of the dyeing liquid supply route A and at least any one of the nozzles of the dyeing liquid supply route B by the control of opening and closing of the opening means at that time; and wherein the continuous dyeing machine is configured to simultaneously supply dyeing liquids different from each other in the hue or density to the dyeing liquid supply route A and the dyeing liquid supply route B, respectively, to discharge the dyeing liquids from the opened nozzles, wherein the dyeing liquids different from each other in the hue or density fall on the plate, and then they contact with each other from the width direction on the plate so that they are partially mixed with each other, and then to apply these dyeing liquids to the original tufted carpet for dyeing.

(5) The continuous dyeing machine according to (4), which is configured so that the periods of the opening and closing of the nozzles by the opening means can be set to specific periods, respectively.

(6) The continuous dyeing machine according to (4) or (5), wherein an electromagnetic valve is provided as the opening means in all the nozzles of the dyeing liquid supply route A and the dyeing liquid supply route B.

Advantages of the Invention

According to the present invention, two dyeing liquid supply routes, to which dyeing liquids different from each other in the hue or density are supplied, are simultaneously used, and the discharge of the dyeing liquids from nozzles of the dyeing liquid supply routes is controlled by an opening means, in an dyeing liquid supply applicator part of a conventional continuous dyeing machine. Accordingly, an original tufted carpet can be continuously dyed in expression of various desired patterns different in the hue or density easily regardless of use and nonuse of a differently dyeable pile. Further, the present invention can be realized by improvement of the configuration of a portion of the dyeing liquid supply applicator part of the conventional continuous dyeing machine. Accordingly, the improvement costs are low, and the manufacturing stability and reliability are remarkably high.

BRIEF DESCRIPTION OF THE DRAWINGS

FIG. 1 is a schematic view of a continuous dyeing process by a tufted carpet continuous dyeing machine;

FIG. 2 is a schematic side view of a dyeing liquid supply applicator part of the continuous dyeing machine;

FIG. 3 is a schematic back view of a dyeing liquid supply applicator part of the continuous dyeing machine;

FIG. 4 is a schematic front view of a dyeing liquid supply applicator part of the continuous dyeing machine;

FIG. 5 is a schematic front view of an actual arrangement example of nozzles of the dyeing liquid supply applicator part of the continuous dyeing machine;

FIG. 6 is a schematic front view of a use example of nozzles of the dyeing liquid supply applicator part of the continuous dyeing machine in the present invention;

FIG. 7 shows a basic opening and closing pattern of 164 electromagnetic valves used in Example 3;

FIG. 8 shows a repetitive pattern of the basic opening and closing pattern of FIG. 7; and FIG. 9 is a photograph showing the dyeing state of a whole pattern of an original tufted carpet dyed in Example 3.

BEST MODE FOR CARRYING OUT THE INVENTION

The tufted carpet continuous dyeing method and the tufted carpet continuous dyeing machine of the present invention are described below with reference to the drawings.

FIG. 1 is a schematic view of a continuous dyeing process by a tufted carpet continuous dyeing machine. In FIG. 1, a numeral 1 is an original carpet supply part and supplies an original tufted carpet by continuously feeding it from a wound original tufted carpet roll. A numeral 2 is a jet bulker where an original yarn is crimped as necessary, or dirt is removed. A numeral 3 is a dyeing liquid supply applicator part where a dyeing liquid is applied to the original tufted carpet for dyeing. The dyeing liquid is prepared in a storage tank in advance, delivered to the dyeing liquid supply applicator part in advance before dyeing the original carpet, so that it is possible to flow the dyeing liquid before the original carpet passes the dyeing liquid supply applicator part. A numeral 4 is a steamer which fixes the dyeing liquid applied to the original tufted carpet at a high temperature. A numeral 5 is a washer which washes a residual dyeing liquid to remove it. A numeral 6 is a drying part which completely removes moisture. A numeral 7 is an inspection and rolling up part which mainly performs an appearance inspection and a rolling up operation. For switching of the color of a dyeing liquid or to an original carpet having a different specification, a lead carpet is connected between original carpets so that dyeing can be continuously conducted. The present invention is characterized in that the dyeing liquid supply applicator part 3 is improved in the continuous dyeing process of the continuous dyeing machine described above.

Conventionally known processes can be selected and adopted as they are, for the processes of the continuous dyeing machine other than the dyeing liquid supply applicator part.

As the original tufted carpet used in the present invention, conventionally known ones can be appropriately used. Examples thereof include one obtained by tufting a pile yarn made of a material such as nylon or wool into a synthetic fiber backing fabric having a width of 1.8 to 4.1 m at a pile height of 4 to 30 mm and a pile basis weight of 250 to 1300 $g/m^2$. As the dyeing liquid, conventionally known ones are appropriately used. Examples thereof include an acid dye, a cationic dye, and a dispersion dye, with a level dyeing agent, a precipitation inhibitor, a pH adjuster, an antifoaming agent, and the like appropriately added thereto.

Next, a schematic view from a side direction of the dyeing liquid supply applicator part of the continuous dyeing machine is shown in FIG. 2. Further, schematic views from the back direction and the front direction of the dyeing liquid supply applicator part are shown in FIGS. 3 and 4, respectively. In FIGS. 2 to 4, a numeral 8 is an original tufted carpet, numerals 9 and 10 are respectively a dyeing liquid supply route A and a dyeing liquid supply route B which configure routes independent from each other. The dyeing liquid supply route A and the dyeing liquid supply route B are supplied with dyeing liquids 11 and 12, respectively. Then, the dyeing liquid supply route A and the dyeing liquid supply route B deliver these dyeing liquids by pumps 13 and 14, respectively, and supply the dyeing liquids 11 and 12 to nozzles 19 and 20, respectively, after flowing the dyeing liquids uniformly in the width direction at double structure piping parts 15 and 16. The flow rate by the pumps is set according to the specification of an original carpet to be dyed, and is constant during dyeing. The flow rate is set by a formula: original carpet basis weight×pickup×original carpet width×original carpet speed. Opening means 17 and 18 such as electromagnetic valves or pinch cocks are provided immediately before the nozzles 19 and 20, respectively. The nozzles 19 and 20 are opened and closed by the opening and closing control of the opening means, so that the discharge of the dyeing liquids from the nozzles can be executed and stopped. As to the arrangement of the nozzles 19 and 20, many nozzles are present in the width direction as shown in the front view of FIG. 5. Conventionally, only nozzles located above a dyeing width part of an original carpet (running part of an original carpet) discharge a dyeing liquid, and nozzles located above end parts on both sides, which are not to be dyed, are closed by the opening means so that a dyeing liquid does not flow from the closed nozzles. The dyeing liquid discharged from the nozzles drops onto a plate 21 and forms a uniform flow there to be applied onto the original tufted carpet.

In the conventional method, as shown in FIGS. 2 and 4, setting includes moving only the nozzles of the dyeing liquid supply route to be used, for example, the nozzles 19 of the dyeing liquid supply route A, out of the dyeing liquid supply routes A and B, to an upper space of the plate 21; and retreating the nozzles 20 of the dyeing liquid supply route B not to be used from the upper space of the plate 21 backward so that the tips of the nozzles 20 are positioned above a waste liquid groove 22. In this setting, only the dyeing liquid 11 supplied to the dyeing liquid supply route A is discharged from the nozzles 19 so that only a monotonous single hue is imparted to an original carpet. Further, in the conventional dyeing, while only one of the dyeing liquid supply routes, e.g. the route A is used and an original carpet is dyed only with the dyeing liquid from the nozzles 19, the other dyeing liquid supply route B is made ready for a flow of a dyeing liquid to be used next. Accordingly, when the dyeing by the dyeing liquid supply route A is finished, the nozzles 19 are retreated backward, while the nozzles 20 of the dyeing liquid supply route B are moved to the upper space of the plate 21 so as to promptly switch the dyeing liquid supply route A to the dyeing liquid supply route B. Accordingly, in the conventional dyeing, the nozzles 19 and 20 of the dyeing liquid supply routes A and B are never simultaneously used for dyeing and thus are never alternately aligned in the width direction.

On the contrary, in the dyeing of the present invention, the dyeing liquid supply routes A and B are simultaneously used as shown in the front view of FIG. 6. That is, the nozzles 19 and 20 of the dyeing liquid supply routes A and B are simultaneously moved to the upper space of the plate 21, and the nozzles 19 and 20 are alternately aligned in the width direction. Then, at least one of the nozzles 19 of the dyeing liquid supply route A and at least one of the nozzles 20 of the dyeing liquid supply route B are opened by the control of opening and closing of the opening means 17 and 18 so that dyeing liquids from the opened nozzles are discharged onto the plate 21 to be applied to an original carpet. The nozzle(s) 19 and the nozzle(s) 20 which are opened at this time can be individually 1/10 or more, 1/8 or more, 1/6 or more, 1/5 or more, 1/4 or more, or further all of the corresponding nozzles present. In this case, when the dyeing liquid 11 supplied to the dyeing liquid supply route A and the dyeing liquid 12 supplied to the dyeing liquid supply route B are made different from each other in the hue or density, a gradational hue or a hue of mixed colors can be imparted to an original carpet. For example, in FIG. 6, the nozzle 19 of the dyeing liquid supply route A is opened only in the 4th and the 6th from the left side and in the 3rd and the 5th from the right side including the nozzles 19 and 20, and the nozzle 20 of the dyeing liquid supply route B is opened only in the 3rd and the 7th from the left side and the 4th, the 6th, and the 8th from the right side including the nozzles 19 and 20, by the opening and closing control of the opening means 17 and 18, and the dyeing liquids are discharged only from these opened nozzles so that the discharged dyeing liquids are reflected on the original tufted carpet 8 for dyeing. Specifically, when a red dyeing liquid is flowed into the dyeing liquid supply route A and a black dyeing liquid is flowed into the dyeing liquid supply route B, an (a) part of the original tufted carpet 8 in FIG. 6 is dyed with the single red color, a (b) part is dyed with the black single color, a (c) part is dyed in such a manner as to gradually change the hue thereof from the red color to the black color (gradation), and a (d) part is dyed in a hue of mixture of the black and red colors. In this case, dyeing including a change from the part (a) to the part (d) over the width direction of the original tufted carpet continuously appears, so that it is possible to realize a complicated pattern of mixture of the hues of the parts (a) to (d).

In the above example, the opening and closing of the nozzles are not changed during running of a single lot of original tufted carpet in the proceeding direction. However, adopting an electromagnetic valve as the opening means of the nozzles facilitates free opening and closing of the nozzles even during running of an original carpet. In that case, the hue of dyeing in the longitudinal direction of an original carpet can also be freely changed. In the present invention, the electromagnetic valve is preferably provided as the opening means in all the nozzles of the dyeing liquid supply routes A and B in order to enable such control of opening and closing of the nozzles. As to the electromagnetic valve, conventionally known ones are used. The opening and closing pattern thereof can be set for control by, for example, an electric signal. In general, the electromagnetic valve only opens and closes a nozzle, and it cannot change the degree of the opening and the closing of a nozzle, but it can control a nozzle by freely setting the period of each of the opening and the closing of the nozzle to a specific period. For example, when the running speed of an original tufted carpet in the longitudinal direction is 14 cm/sec, opening of an electromagnetic valve of a nozzle for 1 second causes, in principle, reflection of a dyeing liquid from the nozzle for 14 cm in the longitudinal direction, and closing for 1 second causes no influence of the dyeing liquid of the nozzle for 14 cm in the longitudinal direction. By appropriate setting of the period of each of the opening and the closing of the electromagnetic valve of the nozzle, a hue having a change not only in the width direction but also in the longitudinal direction of an original carpet can be imparted.

When two routes including the dyeing liquid supply route A and the dyeing liquid supply route B are used as in the present invention, the total flow rate of dyeing liquids by the pumps 13 and 14 is preferably set so as to become a flow rate for the specification of an original tufted carpet. For example, when the flow rate for the specification of an original carpet is 100 L/min, the flow rate can be adjusted, for example, by setting the pump 13 to a flow rate of 50 L/min (50%) and the pump 14 to a flow rate of 50 L/min (50%), or by setting the pump 13 to a flow rate of 70 L/min (70%) and the pump 14 to a flow rate of 30 L/min (30%). In addition, the flow rate of a dyeing liquid is constant, and therefore it is necessary to consider averaging, as much as possible, the number of opened nozzles in the width direction. For example, when the pump 13 is set to a flow rate of 30%, a pattern is preferably designed so that the number of opened nozzles is about 30%. When the number of opened nozzles is too large compared to a flow rate, the inner pressure of pipes of a dyeing liquid supply route lowers, making the discharge amount of a dyeing liquid from the nozzles unstable. When the number of opened nozzles is too small compared to a flow rate, the inner pressure of pipes of a dyeing liquid supply route rises, possibly causing blowout of a dyeing liquid from an air vent.

In the continuous dyeing method of the present invention, the dyeing liquids 11 and 12 simultaneously supplied to the dyeing liquid supply route A and the dyeing liquid supply route B, respectively, are made different from each other in the hue or density as described above. Accordingly, dyeing for expression of a complicated pattern having a change in the hue or density and looking high-class can be imparted to an original tufted carpet. In addition, by controlling the opening and closing period of each nozzle with the electromagnetic valve, it is possible to realize dyeing for expression of a pattern not only in the width direction but also in the longitudinal direction of an original tufted carpet. In the dyeing method by the conventional continuous dyeing machine, a hue having a density change cannot be reflected on an original tufted carpet unless a differently dyeable pile yarn or the like is used. According to the method of the present invention, however, expression of various high design/high quality patterns can be efficiently imparted to an original tufted carpet easily at low costs.

EXAMPLES

The effects of the present invention are shown below by way of examples, but the present invention is not limited to the examples.

Example 1

As a pile yarn, a nylon original yarn of 2850T (blended yarn of bright/deep and dull/deep) was used. The terms "bright" and "dull" are expressions of gloss, and the "bright" represents a glossy state and the "dull" represents a non-glossy state. The term "deep" is an expression of dyeability and represents dense dyeing with an acid dye.

Cones of the original yarn were set randomly in the gauge direction and penetrated into a 100 g/m$^2$ spunbonded backing fabric at a specification including alternate pile heights of 3.5 mm and 2.5 mm and a pile basis weight of 580 g/m$^2$ to make an original carpet. The width of the original carpet was set to 4.10 m.

As the dyeing liquids, the following two colors (A) and (B) were prepared.

(A) An acid dye was blended into a light green (0.1% o.w.f.), and certain amounts of the dye, a level dyeing agent, a precipitation inhibitor, an acid, and a penetrant were added to a storage tank to prepare a liquid.

(B) An acid dye was blended into a deep green (1.0% o.w.f.), and a liquid was prepared in the same manner.

A dyeing liquid supply applicator was prepared which includes a dyeing liquid supply route A and a dyeing liquid supply route B being independent from each other, with each of the dyeing liquid supply routes A and B having 82 nozzles each capable of executing and stopping the discharge of the dyeing liquids by the opening and closing of an electromagnetic valve. The nozzles of the dyeing liquid supply routes A and B for use were set so as to be alternately aligned in the width direction, starting with a nozzle of the dyeing liquid supply route A from the right direction viewed from the front of the dyeing liquid supply applicator.

An input to a controller of the dyeing liquid supply applicator was made in advance to open the electromagnetic valves of all the nozzles of the dyeing liquid supply routes A and B. The dyeing liquid (A) was flowed into the dyeing liquid supply route A and the dyeing liquid (B) was flowed into the dyeing liquid supply route B. An original carpet was connected to a lead carpet to be connected to an original carpet supply part of a continuous dyeing machine, and was run at an original carpet speed of 14 cm/sec. The original carpet was caused to pass a jet bulker at a high temperature to remove an oil solution and dirt and to crimp the pile yarn. Each pump was simultaneously activated immediately before the original carpet passed the dyeing liquid supply applicator, so that the dyeing liquids were discharged from the opened nozzles onto a plate, whereby the dyeing liquids were applied to the original carpet through the plate. Subsequently, steaming was conducted by a steamer for about 5 minutes so that the dyes were fixed to a pile part of the original carpet. After the steaming, a residual dye was removed with a washer, and then drying for finishing was conducted.

In the original carpet dyed as described above, light green and deep green were repeated in the width direction, thus realizing a pattern having designability by gradation of light and deep green colors.

Example 2

An original carpet identical with the one in Example 1 was made and used. As the dyeing liquids, the following two colors (C) and (D) were prepared.

(C) An acid dye was blended into a light green (0.1% o.w.f.), and certain amounts of the dye, a level dyeing agent, a precipitation inhibitor, an acid, and a penetrant were added to a storage tank to prepare a liquid.

(D) An acid dye was blended into a light yellow (0.1% o.w.f.), and a liquid was prepared in the same manner.

The same dyeing liquid supply applicator as in Example 1 was used. An input to the controller of the dyeing liquid supply applicator was made in advance to open the electromagnetic valves of all the nozzles of the dyeing liquid supply routes A and B. The dyeing liquid (C) was flowed into the dyeing liquid supply route A and the dyeing liquid (D) was flowed into the dyeing liquid supply route B. An original carpet was connected to a lead carpet to be connected to an original carpet supply part of a continuous dyeing machine, and was run at an original carpet speed of 14 cm/sec. The original carpet was caused to pass a jet bulker at a high temperature to remove an oil solution and dirt and to crimp the pile yarn. Each pump was simultaneously activated immediately before the original carpet passed the dyeing liquid supply applicator, so that the dyeing liquids were discharged from the opened nozzles onto a plate, whereby the dyeing liquids were applied to the original carpet through the plate. Subsequently, steaming was conducted by a steamer for about 5 minutes so that the dyes were fixed to a pile part of the original carpet. After the steaming, a residual dye was removed with a washer, and then drying for finishing was conducted.

In the original carpet dyed as described above, green and yellow were repeated in the width direction, and a part between green and yellow included gradation due to transition between green and yellow, thus realizing a pattern having designability by the two green and yellow colors.

Example 3

An original carpet identical with the one in Example 1 was made and used. As the dyeing liquids, the following two colors (E) and (F) were prepared.

(E) An acid dye was blended into a light yellow (0.1% o.w.f.), and certain amounts of the dye, a level dyeing agent, a precipitation inhibitor, an acid, and a penetrant were added to a storage tank to prepare a liquid.

(F) An acid dye was blended into a deep blue (1.0% o.w.f.), and a liquid was prepared in the same manner.

The same dyeing liquid supply applicator as in Example 1 was used. An input of an opening and closing pattern, as shown in FIG. 7, of the electromagnetic valves of the nozzles was made in advance to the controller of the dyeing liquid supply applicator. The dyeing liquid (E) was flowed into the dyeing liquid supply route A and the dyeing liquid (F) was flowed into the dyeing liquid supply route B. A tufted carpet was dyed in the same manner as in Example 1 except mentioned above, and was finished.

FIG. 7 represents the opening and closing states of 164 nozzles in the long side direction, which were aligned in the width direction, and represents the opening and closing states of the nozzles per sec with a single square in the short side direction. FIG. 7 shows a basic opening and closing pattern of the nozzles, and this basic pattern is repeated over time. FIG. 8 shows a pattern obtained by repeating the basic pattern of the nozzles in FIG. 7. A colored part shows the opening of an electromagnetic valve, and a colorless part shows the closing of an electromagnetic valve. A deep colored part represents the dyeing liquid (E) from the dyeing liquid supply route A, and a light colored part represents the dyeing liquid (F) from the dyeing liquid supply route B.

FIG. 9 shows a photograph of the original carpet dyed in Example 3 at an inspection part. As is understood from FIG. 9, in the original carpet dyed as described above, yellow and blue were repeated not only in the width direction but also in the length direction, and the original carpet included gradation due to transition between yellow and blue in the width direction and the length direction. Accordingly, it was possible to realize a pattern having high quality and designability by the two yellow and blue colors.

INDUSTRIAL APPLICABILITY

According to the present invention, high design/high quality dyeing can be realized efficiently at low costs compared to conventional dyeing of a tufted carpet. Therefore, the present invention is remarkably useful.

Explanation of Reference Number

1: original carpet supply part
2: jet bulker
3: dyeing liquid supply applicator part
4: steamer
5: washer
6: drying part
7: inspection and rolling up part
8: riginal tufted carpet
9: yeing liquid supply route A
10: dyeing liquid supply route B
11: dyeing liquid
12: dyeing liquid
13: pump
14: pump
15: double structure piping part
16: double structure piping part
17: opening means
18: opening means
19: nozzle
20: nozzle
21: plate
22: waste liquid groove

What is claimed:

1. A tufted carpet continuous dyeing method for dyeing a long original tufted carpet by applying a dyeing liquid to the original tufted carpet while running the original tufted carpet in the longitudinal direction with a continuous dyeing machine, wherein nozzles of a dyeing liquid supply route A and nozzles of a dyeing liquid supply route B which are independent from each other are arranged in such a manner that they are aligned together in the width direction in alternate order, and at least one of the nozzles of the dyeing liquid supply route A and at least one of the nozzles of the dyeing liquid supply route B are opened by the control of opening and closing of opening means; wherein the dyeing liquid discharged from the opened nozzles are applied in such a manner that the dyeing liquid uniformly flows on the original tufted carpet via a tilted plate; and wherein dyeing liquids different from each other in the hue or density are simultaneously supplied to the dyeing liquid supply route A and the dyeing liquid supply route B, respectively, the dyeing liquids are discharged from the opened nozzles, the dyeing liquids different from each other in the hue or density simultaneously fall on the plate aligned in the width direction, and then they contact with each other from the width direction on the plate so that they are partially mixed with each other, and then these dyeing liquids are applied to the original tufted carpet for dyeing.

2. The method according to claim 1, wherein the periods of the opening and closing of the nozzles by the opening means are set to specific periods, respectively.

3. The method according to claim 1 or 2, wherein the opening means is controlled so that the dyeing liquid is discharged from the nozzles only in a width size of the tufted carpet to which the dyeing liquid is to be applied.

4. A method of continuous dyeing of a long original tufted carpet, comprising:

moving the original tufted carpet in a longitudinal direction;

simultaneously and independently supplying a first dyeing liquid and a second dyeing liquid, which differ in at least one of hue and density, to a plurality of nozzles A and B, respectively, wherein nozzles A and B are aligned across a width of the original tufted carpet in alternating order;

discharging the first and second dyeing liquids from aligned nozzles A and B simultaneously onto a plate so that the first and second dyeing liquids contact each other and are at least partially mixed with each other; and uniformly applying the at least partially mixed dyeing liquids to the original tufted carpet through the plate as the original tufted carpet moves in the longitudinal direction.

5. The method of claim 4, wherein discharging the first and second dyeing liquids from the nozzles includes executing and stopping the discharge of the dyeing liquids by the opening and closing of a nozzle opening means.

* * * * *